United States Patent [19]

Moriya

[11] Patent Number: 4,832,244

[45] Date of Patent: May 23, 1989

[54] MULTIPLE SHEET FEED APPARATUS FOR A PRINTER

[75] Inventor: Mikio Moriya, Tokorozawa, Japan

[73] Assignee: Citizen Watch Co., Ltd., Tokyo, Japan

[21] Appl. No.: 837,357

[22] Filed: Mar. 6, 1986

[30] Foreign Application Priority Data

Mar. 18, 1985 [JP] Japan ..... 60-53599

[51] Int. Cl.[4] ..... B65H 20/04

[52] U.S. Cl. ..... 226/115; 226/156

[58] Field of Search ..... 226/108, 115, 120, 129, 226/152, 156, 157; 192/26, 27, 415

[56] References Cited

U.S. PATENT DOCUMENTS

| | | | |
|---|---|---|---|
| 3,568,906 | 6/1969 | Jones | 226/157 X |
| 3,684,068 | 8/1972 | Ford | 192/415 X |
| 4,109,843 | 8/1978 | Usvi et al. | 226/115 X |
| 4,236,660 | 12/1980 | Kanemura | 226/115 X |
| 4,443,125 | 4/1984 | Hirano | 192/26 X |

FOREIGN PATENT DOCUMENTS

| | | |
|---|---|---|
| 51-58125 | 5/1976 | Japan . |
| 51-59526 | 5/1976 | Japan . |
| 53-42915 | 4/1978 | Japan . |
| 53-87807 | 8/1978 | Japan . |
| 53-102122 | 9/1978 | Japan . |
| 57-50194 | 10/1982 | Japan . |
| 58-394 | 1/1983 | Japan . |

*Primary Examiner*—John M. Jillions

*Attorney, Agent, or Firm*—Lowe, Price, LeBlanc, Becker & Shur

[57] ABSTRACT

A multiple paper sheet feed apparatus, suitable for use with a printer, comprises a plurality of sheet feed mechanisms each of which comprises a sheet feed roller and a clutch spring which selectively assumes either a first operation state for rotatively coupling the roller to the shaft, or a second operational state for releasing the rotative coupling. During rotation of a single sheet feed shaft common to all the feed mechanisms, solenoids corresponding to the respective clutches are selectively energized so that one or more corresponding armatures are disengaged from one or more associated clutch springs so as to cause the associated springs to assume their respective first states. As a result, one or more or all of the sheet feed mechanisms are rendered operative so that a selected one or more or all of the sheets are fed therethrough.

4 Claims, 1 Drawing Sheet

MULTIPLE SHEET FEED APPARATUS FOR A PRINTER

BACKGROUND OF THE INVENTION

1. Technical Field

The present invention relates to a multiple sheet feed apparatus for a printer, which is capable of performing a sheet feed operation through arbitrarily selected one or more of a plurality of sheet feed mechanisms in the apparatus.

2. Background of the Prior Art

Conventionally, various sheet feed apparatuses of the dual type, having two feed systems mounted therein and each adapted to feed or transport a corresponding sheet of paper for printing, have been known. Examples of these are described in Japanese patent publication No. 58-394 and corresponding provisional patent publication No. 51-58125 (hereinafter, referred to as Prior Art Reference 1), Japanese provisional patent publication No. 51-59526 (Prior Art Reference 2), Japanese patent publication No. 57-50194 and corresponding provisional patent publication No. 53-42915 (Prior Art Reference 3), Japanese provisional patent publication No. 53-87807 (Prior Reference Art 4), and Japanese provisional patent publication No. 53-102122 (Prior Art Reference 5).

Prior Art 1, 2 References each disclose apparatus that comprises a first sheet feed roller secured to a sheet feed roller shaft, a second sheet feed roller secured to the roller shaft through a one-way clutch, and a first sheet feed driving means for driving the roller shaft, a second sheet feed driving means for driving the second feed roller, respectively. In these prior art arrangements, the one-way clutch is so arranged as to be locked or engaged when the roller shaft is rotatively driven by the first sheet feed driving means, and released or disengaged when the second feed roller is rotatively driven by the second sheet feed driving means. Accordingly, when the sheet feed roller shaft is rotated by the first sheet feed driving means, the first and second rollers are caused to rotate to simultaneously feed corresponding first and second sheets. On the other hand, when the second sheet feed roller is rotated by the second sheet feed driving means, only the second sheet alone is activated.

Prior Art Reference 3 comprises a journal sheet feed roller, a second sheet feed roller coupled to the journal sheet feed roller through a one-way clutch, a journal sheet feed roller driving means consisting of a ratchet wheel and feed pawls for driving the journal sheet feed roller, and a first sheet feed means disposed at a location facing an outlet to which a receipt sheet is delivered by the second sheet feed roller, wherein the one-way clutch is arranged so that it is locked when the journal sheet feed roller is rotatively driven by the journal sheet feed roller driving means, whereas the clutch is released when the receipt sheet is delivered by the first sheet feed means and causes the second sheet feed roller to rotate. In this prior art arrangement, when the journal sheet feed roller is rotated by the journal sheet feed roller driving means, the second sheet feed roller is also rotated for simultaneous delivery of both of the journal sheet and the receipt sheet, whereas, when the second sheet feed roller is merely driven by the first sheet feed means through the delivered receipt sheet, the journal sheet feed roller is rendered inoperative so that the receipt sheet alone is delivered.

Thus, the teaching of Prior Art Reference 3 is basically the same, in principle, as that of Prior Art References 1, 2. More specifically, the journal sheet feed roller, the second sheet feed roller, the journal sheet feed roller driving means and the first sheet feed means in Prior Reference Art 3 correspond to the first sheet feed roller, the second sheet feed roller, the first sheet feed driving means and the second sheet feed driving means in Prior Art References 1, 2, respectively.

Prior Art References 3 4 and 5 of the dual sheet feed system type each comprise two one-way clutches, each of which is mounted on a corresponding one of drive shafts of the respective sheet feed systems in a manner providing opposite directions of transmission of motion with respect to each other. Further, a motor for driving the drive shafts is provided, which is rotated in either forward or reverse direction to alternately render the two drive shafts effective, thereby switchingly and alternately delivering the sheets in the two systems.

Prior Art References 1–3 require two driving means for driving the two sheet feed systems juxtaposed in a printer to deliver the first and second sheets therethrough, and are thus complex in construction and high in cost and, furthermore, require a broad space for installation. Although these arrangments are capable of delivering both first and second sheets simultaneously, or only the second sheet, they cannot independently deliver the first sheet alone.

Prior Art References 4 and 5 merely require a single driving means, and are thus simple in construction and capable of independently delivering either of the sheets loaded in the respective feeding systems, as distinct from Prior Art References 1–3. However, Prior Art References 4, 5 have the drawback that the sheet feed seed is low in their operational mode of feeding both the sheets, because, in such mode, the motor is first rotated in the forward direction to deliver one of these sheets, and then rotated in the reverse direction for feeding another sheet, as mentioned above.

SUMMARY OF THE INVENTION

An object of the present invention is to provide a multiple sheet feed apparatus in a printer, which is capable of simultaneously feeding all the multiple trains of sheets of paper for printing, as well as selectively feeding arbitrarily selected one or more sheets.

Another object of the present invention is to provide a multiple sheet feed apparatus in a printer, which is simple in construction and low in cost and requires a small space for installation.

According to the present invention, a multiple sheet feed apparatus in a printer comprises a plurality of sheet feed mechanisms juxtaposed therein and each having a sheet feed roller. A plurality of clutch means are provided, which correspond to the sheet feed rollers, respectively. Each clutch means is selectively operable in a first operational state for rotatively coupling a corresponding one of the sheet feed rollers to a single sheet feed shaft which is common to all the sheet feed mechanisms, and in a second operational state for releasing the coupling between the corresponding roller and the shaft. Further, there are provided a plurality of clutch controlling means which correspond to the clutch means, respectively, and rotary driving means for rotatively driving the sheet feed shaft.

During rotation of the sheet feed shaft, the operational states of the respective clutch means are controlled by the clutch controlling means, so that a sheet feed operation through desired one or more or all of the sheet feed mechanisms is performed.

DETAILED DESCRIPTION OF THE PREFERRED EMBODIMENTS

Figure 1:
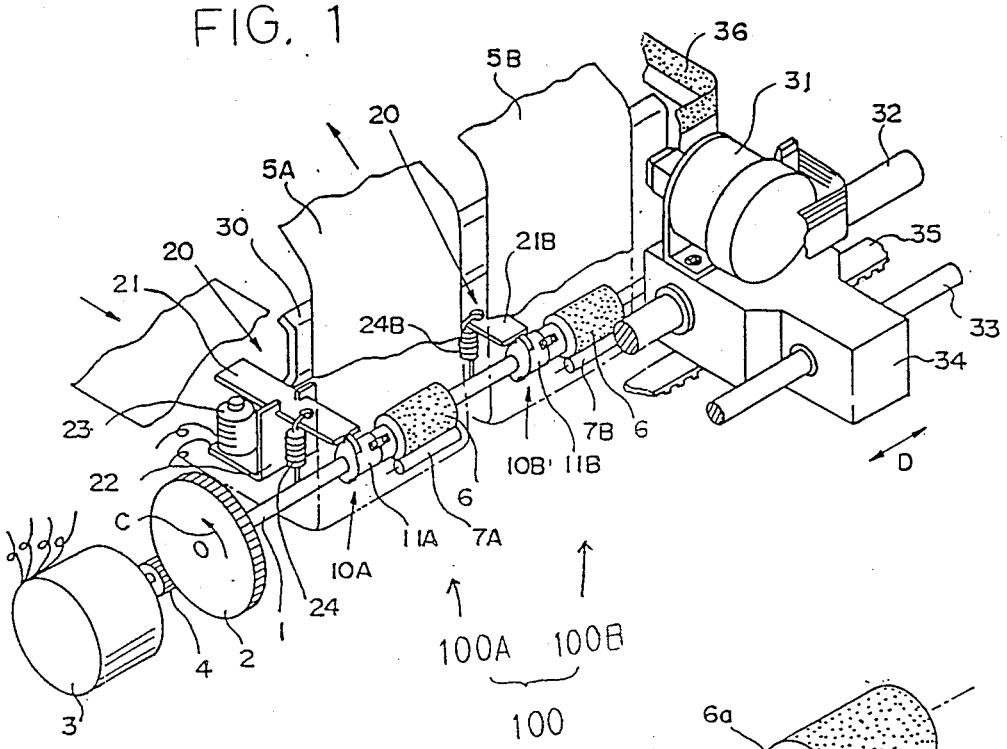
FIG. 1 is a perspective view of a dual sheet feed apparatus according to an embodiment of the present invention.
Figure 2:
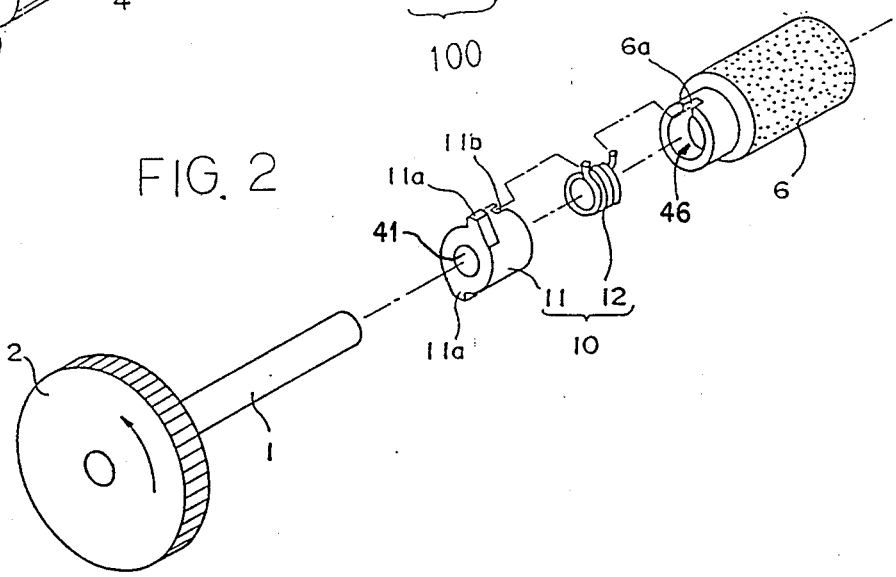
FIG. 2 is an enlarged exploded perspective view illustrating a clutch of FIG. 1.

With reference to FIGS. 1 and 2, a dual sheet feed apparatus according to an embodiment of the present invention will be now explained.

The dual sheet feed apparatus 100 comprises two sheet feed mechanisms 100A and 100B, which are juxtaposed with each other along a common single sheet feed shaft 1. Fixed to one end of the shaft 1 is a sheet feed gear 2 which meshes with a motor gear 4 secured to an output shaft of a stepping motor 3, these elements 2–4 forming rotary driving means for rotatively driving the feed shaft 1. Sheet feed rollers 6A and 6B are fitted on the shaft 1 and spaced from each other, and pressure rollers 7A and 7B are rotatably supported by appropriate supporting means (not shown) in urging contact with the feed rollers 6A, 6B, respectively, so as to positively hold first and second sheets 5A, 5B of paper for printing. Sheets 5A and 5B are loaded in the two feed mechanisms 100A, 100B, between pressure rollers 7A and 7B and the feed rollers 6A, 6B for frictional delivery of these sheets 5A, 5B.

As will be described hereinbelow, there are provided clutches 10A and 10B for causing the feed rollers 6A 6B to be engaged with and disengaged from the sheet feed shaft 1, and clutch controlling means 20A and 20B (the latter is partly illustrated) for controlling the engaging-/disengaging operation of the clutches 10A, 10B. The controlling means 20A and 20B cooperate with the above-mentioned corresponding elements 1–4, 6A, 7A, 10A; 1–4, 6B, 7B, 10B, respectively, to form the sheet feed mechanisms 100A and 100B.

Since the feed mechanisms 100A and 100B (more specifically, the sheet feed rollers 6A and 6B; the pressure rollers 7A and 7B; the clutches 10A and 10B; and the clutch controlling means 20A and 20B) are identical in construction with each other, these suffixes A, B will be added hereinbelow only when required to distinguish an element included in one of the mechanisms from a corresponding element in another mechanism, otherwise they are omitted. As for the sheets 5A, 5B, the suffixes A, B will be employed in the same manner as mentioned above.

The clutch 10 (FIG. 2) consists of a clutch ratchet 11 and a clutch spring 12. The clutch ratchet 11 is rotatably fitted on the sheet feed shaft 1 extending through a central through hole 41 formed in the ratchet 11, an air-core portion of the spring 12, and a central through hole 46 formed in the roller 6, and has an outer peripheral surface thereof formed at diametrically opposite sides with two engaging pawls **11*a*, and an end surface thereof formed with a groove 11*b*. The clutch spring 12 composed of a coiled spring is forcedly fitted on the feed shaft 1, and has one end thereof inserted in the groove 11*b* of the ratchet 11 and another end thereof inserted in a groove 6*a* formed in an annular wall of the sheet feed roller 6, which wall is integrally formed in the roller 6 at a side of the roller 6 facing the clutch 10 and adapted to take out the output from the clutch 10 through the spring 12. Further, the clutch spring 12 has its inner diameter which is smaller than the outer diameter of the shaft 1 so that it tightens on the shaft 1 when it is in a free state, and is wound in the direction of releasing the shaft 1 when the sheet feed gear 2 is rotated in the direction of arrow C, with the pawl 11*a* of the clutch ratchet 11 is engaged with a trigger armature 21 of the clutch controlling means 20**, as will be fully explained hereinafter.

The clutch controlling means 20 consists of a sheet feed trigger solenoid 23 secured to a supporting plate 22, the above-mentioned trigger armature 21 which is pivotally mounted on the plate 22, and an armature spring 24. The armature 21 is disposed so that a first end portion thereof, which serves as an engaging portion of the controlling means 20, is engageable with and disengageable from the pawls **11*a* of the clutch ratchet 11, and a second end portion thereof is located opposite the trigger solenoid 23. The armature spring 24 is arranged so as to always urge the armature 21 in the direction of causing the first end of the armature 21 kept in forced contact with the pawl 11*a* of the ratchet 11, and cooperates with the solenoid 23 to form a controlling mechanism of the controlling means 20 for controlling engagement and disengagement between the engaging first end portion of the controlling means 20 and the pawl 11*a* of the ratchet 11**.

A platen 30 is mounted above the sheet feed roller 6 and extends in parallel with the sheet feed shaft 1. Disposed opposite the platen 30 is a printing head 31 which is fixed to a carriage 34 slidably mounted on guide shafts 32, 33 extending in parallel with the sheet feed shaft 1. Further, the printing head 31 is arranged to be driven by a timing belt 35 which is in turn driven by appropriate means, not shown, for reciprocal motion in the directions of arrow D. Furthermore, an ink ribbon 36 is disposed between the platen 30 and the pinting head 31.

In the following, the operation of the dual sheet feed apparatus 100 as constructed above will be explained. At first, the first and second sheets 5 of printing paper for two feeding systems, i.e., the sheet feed mechanisms 100A, 100B are set between the sheet feed rollers 6 and the pressure rollers 7 and between the platen 30 and the ink ribbon 36.

When the sheet feed shaft 1 is rotated in the direction of arrow C and the trigger armature 21 is engaged with the pawl **11*a* of the clutch ratchet 11, the associated clutch 10 assumes its second operational state wherein the clutch spring 12 of the clutch 10 is increased in inner diameter to release the shaft 1. Accordingly, the sheet feed roller 6 is drivingly disconnected from the sheet feed shaft 1, and is kept unrotatable so as not to deliver the associated sheet 5 even when the shaft 1** is rotated.

On the other hand, when the sheet feed trigger solenoid 23 is momentarily energized, the second end of the armature 21 is electromagnetically attracted toward the thus energized solenoid 23, so that the first end of the armature 21 is disengaged from the contacted one of the pawls **11*a* of clutch ratchet 11 against the force of the armature spring 24. As a result, the clutch spring 12 assumes its first operational state wherein it decreases in diameter to grip the shaft 1 for rotational coupling between the feed roller 6 and the shaft 1 through the clutch spring 12. In this state, when the stepping motor 3 is driven through the motor gear 4 and the sheet feed gear 2 so as to cause the sheet feed shaft 1 to rotate, the feed roller 6, the clutch ratchet 11 and the clutch spring 12 are rotated in unison with the shaft 1. At the time, shaft 1 is rotated by one half revolution, and another pawl 11***a* of the ratchet 11 is brought into engagement with the trigger armature 21 so that the rotative driving coupling between the shaft 1 and the roller 6 is released again. Upon release of the driving coupling, i.e., after the shaft 1 is rotated for an angle slightly larger than an angle of 180-degree, the rotation of the motor 3 is caused to stop. In this manner, the roller 6 rotates by just one half revolution until the engagement is established between the pawl 11*a* of the ratchet 11 and the restored trigger armature 21, so as to deliver the associated sheet 5 of printing paper advanced by one line by the rotation of the roller 6.

Therefore, in order to feed only one of the sheets e.g., only the first sheet 5A, the trigger solenoid 23A alone is energized so that a pawl 11*a* of the clutch ratchet 11A is disengaged from the trigger armature 21A, to bring the clutch 10A into an engaged state as mentioned above. As a result, the feed roller 6A alone is rendered rotatable with the rotation of the stepping motor 3 for delivery of the first sheet 5A. In this case, the trigger armature 21B remains engaged with a pawl 11*a* of the associated clutch ratchet 11B to render the roller 6B unrotatable so as to block delivery operation of the second sheet 5B even if the feed shaft 1 rotates.

On the other hand, in order to feed sheet 5B alone, only the trigger solenoid 23B is energized to release the engagment between the trigger armature 21B and a pawl 11*a* of the clutch ratchet 11B to allow the roller 6B to rotate. This makes it possible to deliver the second sheet 5B alone.

In the event that simultaneous feeding of both the first and second sheets 5A, 5B is required, both the trigger solenoids 23A, 23B are energized. As a consequence, the sheet feed apparatus 100 operates to simultaneously deliver both the sheets 5A, 5B through the sheet feed mechanisms 100A and 100B, respectively.

In the aforementioned preferred embodiment, two sheet feed mechanisms are provided. However, three or more similar meachanisms may be provided in the sheet feed apparatus according to the present invention. Furthermore, although a spring type clutch is employed as the clutch 10 in the aforementioned preferred embodiment, other types of clutches may also be employed. Further, in place of the clutch ratchet 11 explained in the preferred embodiment, which is formed with the two pawls 11*a* so that the sheet 5 is delevered by one line with one half revolution of the feed shaft 1, different types of clutch ratchets may be employed. For instance, a clutch ratchet may be formed with one or not less than three pawls so that the sheet 5 is fed by one line with one or not more than one third revolution of sheet feed shaft 1.

What is claimed is:

1. A multiple sheet paper feed apparatus, suitable for feeding paper to a printer, comprising:

a plurality of sheet feed mechanisms juxtaposedly disposed in said apparatus, each of said mechanisms having a sheet feed roller and a pressure roller biased toward said sheet feed roller for delivering therebetween a corresponding sheet for printing;

a single sheet feed shaft which is common to all of said sheet feed mechanisms and passes through each of said sheet feed rollers and supports the feed rollers in such a manner that the feed rollers are rotatable;

rotary driving means operatively coupled to said single sheet feed shaft for rotatively driving said shaft;

a plurality of clutch means for controlling rotation of said sheet feed rollers, mounted in a manner corresponding to said sheet feed rollers, respectively, each of said clutch means being mounted on said sheet feed shaft at an intermediate portion of said shaft and adjacent to a corresponding sheet feed roller, each clutch means being operable to selectively assume either a first operational state for rotatively coupling the corresponding sheet feed roller to said sheet feed shaft to rotate said coupled sheet feed roller to feed a corresponding sheet, or a second operational state for releasing said rotative coupling between said corresponding roller and said sheet feed shaft, each clutch means having an engaging portion; and a plurality of clutch controlling means for controlling the plurality of clutch means, arranged in a manner corresponding to said clutch means, respectively, each of said clutch controlling means having an engaging portion which is arranged to be movable in a direction substantially perpendicular to said single feed shaft so as to be brought into engagement with and out of engagement from the engaging portion of a corresponding one of said clutch means, each of the engaging portions of said clutch controlling means being operable to switch a corresponding one of said clutch means from said first operational state to said second operational state thereof to thereby rotate the associated sheet feed roller for a predetermined rotational angle, and thereafter to restore said clutch means to said first state thereof, each clutch controlling means cooperating with said sheet feed shaft, said rotary driving means, and said corresponding clutch means to form one of said sheet feed mechanisms, and each of said pressure rollers being always kept biased toward the corresponding sheet feed roller across the thickness of a sheet when the corresponding clutch means assumes either one of said first and second states wherein each of said clutch means includes a clutch spring fitted on said sheet feed shaft, each said spring having first and second ends and a clutch ratchet operatively coupled to said first end of said clutch spring and having at least one pawl as said engaging portion, said clutch controlling means each having an engaging portion thereof selectively engageable with and disengageable from said at least one pawl of said clutch ratchet, and a controlling mechanism for causing said engaging portion to selectively engage with and disengage from said at least one pawl, each of said sheet feed rollers being rotatably fitted on said sheet feed shaft and coupled with said second end of a corresponding clutch spring, each said clutch spring being decreased in diameter to assume said first operational state when the engagement between said pawl of said ratchet and engaging portion of said clutch controlling means is released during rotation of said sheet feed shaft and being increased in diameter to assume said second operational state when said engagement is established between said pawl of said ratchet and said engaging portion of said clutch controlling means, and wherein said clutch controlling means comprises an armature pivotally supported in a direction perpendicular to said single feed shaft and forming said engaging portion, an armature spring for urging said armature in the direction of engaging said armature with said at least one pawl of said clutch ratchet, and a solenoid cooperating with said armature for electromagnetically urging said armature in the direction of disengaging said armature from said at least one pawl, said solenoid cooperating with said armature spring to form said controlling mechanism, said clutch ratchet having a plurality of pawls formed circumferentially on said outer peripheral surface at equal angular intervals, said rotary driving means being adapted to cause said sheet feed shaft to rotate for an angle equal to or larger than said angular interval between adjacent ones of said pawls.

2. The apparatus according to claim 1, wherein:

all of said plurality of clutch means are operable for each to simultaneously assume said first state so that all the sheets are fed simultaneously.

3. The apparatus according to claim 1, wherein:

each of said clutch means includes a helical clutch spring closely fitted around said sheet feed shaft, each said spring having extended first and second ends, and a clutch ratchet operatively coupled to said first end of said clutch spring and having at least one pawl, said clutch controlling means each having an engaging portion thereof which is arranged to be movable in a direction substantially perpendicular to said single shaft and is selectively engageable with and disengageable from said at least one pawl of said clutch ratchet, and a controlling mechanism for causing said engaging portion to selectively engage with and disengage from said at least one pawl, each of said sheet feed rollers being rotatably fitted on said sheet feed shaft and coupled with said second end of a corresponding clutch spring, each said clutch spring being decreased in diameter by movement of said extended ends thereof essentially rotationally about said sheet feed shaft to assume said first operational state when the engagement between said pawl of said ratchet and engaging portion of said clutch controlling means is released during rotation of said sheet feed shaft, and being increased in diameter by a second movement of said extended ends thereof essentially rotationally about said sheet feed shaft to assume said second operational state when said engagement is established between said pawl of said ratchet and said engaging portion of said clutch controlling means.

4. A multiple sheet paper feed apparatus suitable for use with a printer, comprising:

a plurality of sheet feed mechanisms, juxtaposedly disposed in said apparatus, and each of said mechanisms having a sheet feed roller for delivering a corresponding sheet of paper for printing;

a single sheet feed shaft which is common to all of said sheet feed mechanisms and passes through each of said sheet feed rollers and supports the feed rollers in such a manner that the feed rollers are rotatable;

rotary driving means operatively coupled to said single sheet feed shaft, for rotatively driving said shaft;

a plurality of clutch means for controlling rotation of said sheet feed rollers, mounted in a manner corresponding to said sheet feed rollers of said sheet feed mechanisms, respectively, each of said clutch means operable to selectively assume either a first operational state for rotatively coupling a corresponding sheet feed roller to said sheet feed shaft, or a second operational state for releasing said rotative coupling between said corresponding roller and said sheet feed shaft, each clutch means having an engaging portion; and a plurality of clutch controlling means for controlling the plurality of clutch means, arranged in a manner corresponding to said clutch means, respectively, each of said clutch controlling means having an engaging portion which is arranged to be movable in a direction substantially perpendicular to said single feed shaft so as to be brought into engagement with and out of engagement from the engaging portion of a corresponding one of said clutch means, each of the engaging portion of said clutch controlling means being operable to switch a corresponding one of said clutch means from its first operational state to its second operational state to rotate the associated sheet feed roller for a predetermined rotational angle, and thereafter to restore said clutch means to its first state, each clutch controlling means cooperating with said sheet feed shaft, said rotary driving means, and said corresponding clutch means to form one of said sheet feed mechanisms, wherein each of said clutch means includes a helical clutch spring closely fitted around said sheet feed shaft, each said spring having extended first and second ends, and a clutch ratchet operatively coupled to said first end of said clutch spring and having at least one pawl, said clutch controlling means each having an engaging portion thereof selectively engageable with and disengageable from said at least one pawl of said clutch ratchet, and a controlling mechanism for causing said engaging portion to selectively engage with and disengage from said at least one pawl, each of said sheet feed rollers being rotatably fitted on said sheet feed shaft and coupled with said second end of a corresponding clutch spring, each said clutch spring being decreased in diameter by movement of said extended ends thereof essentially rotationally about said sheet feed shaft to assume said first operational state when the engagement between said pawl of said ratchet and engaging portion of said clutch controlling means is released during rotation of said sheet feed shaft and being increased in diameter by a second movement of said extended ends thereof essentially rotationally about said sheet feed shaft to assume said second operational state when said engagement is established between said pawl of said ratchet and said engaging portion of said clutch controlling means, wherein said clutch controlling means comprises a pivotally supported armature forming said engaging portion, an armature spring for urging said armature in the direction of engaging said armature with said pawl of said clutch ratchet, and a solenoid cooperating with said armature for electromagnetically urging said armature in the direction of disengaging said armature from said pawl, said solenoid cooperating with said armature spring to form said controlling mechanism and said clutch ratchet has a plurality of pawls formed circumferentially on said outer peripheral surface at equal angular intervals, said rotary driving means being adapted to cause said sheet feed shaft to rotate for an angle equal to or larger than said angular interval between adjacent ones of said pawls.

* * * * *